US006813864B2

(12) United States Patent
Landis

(10) Patent No.: US 6,813,864 B2
(45) Date of Patent: Nov. 9, 2004

(54) DECKING FOR RECEIPT OF SKYLIGHTS

(75) Inventor: David F. Landis, Murrysville, PA (US)

(73) Assignee: Epic Metals Corporation, Rankin, PA (US)

( * ) Notice: Subject to any disclaimer, the term of this patent is extended or adjusted under 35 U.S.C. 154(b) by 9 days.

(21) Appl. No.: 10/187,250

(22) Filed: Jul. 1, 2002

(65) Prior Publication Data

US 2004/0000107 A1 Jan. 1, 2004

(51) Int. Cl.[7] ..... E04D 13/03
(52) U.S. Cl. ..... 52/200; 52/220.8; 52/72
(58) Field of Search ..... 52/200, 220.8, 52/72

(56) References Cited

U.S. PATENT DOCUMENTS

| | | | |
|---|---|---|---|
| 1,971,160 | A | 8/1934 | Lenke |
| 3,417,527 | A | 12/1968 | Kiekhaefer |
| 3,685,426 | A | 8/1972 | Rosa |
| 4,106,399 | A | 8/1978 | Lawrence, Jr. |
| 4,112,632 | A | 9/1978 | Simpson |
| 4,480,534 | A | 11/1984 | Sloan |
| 4,965,971 | A | 10/1990 | Jean-Jacques et al. |
| 5,099,622 | A | 3/1992 | Sutton |
| 5,172,527 | A | 12/1992 | Ault |
| 5,502,935 | A | 4/1996 | Demmer |
| 5,655,339 | A | 8/1997 | DeBlock et al. |
| 5,778,611 | A | 7/1998 | Michel |
| 5,878,539 | A | 3/1999 | Grubb |
| 5,896,712 | A | 4/1999 | Chao |
| 5,896,713 | A | 4/1999 | Chao et al. |
| 5,983,581 | A | 11/1999 | DeBlock et al. |
| RE36,496 | E | 1/2000 | Sutton |
| 6,035,593 | A | 3/2000 | Chao et al. |
| 6,151,838 | A | 11/2000 | Husein |
| 6,161,348 | A | 12/2000 | Morris |
| 6,164,024 | A | 12/2000 | Konstantin |
| 6,178,707 | B1 | 1/2001 | Bengtson |
| 6,185,885 | B1 | 2/2001 | Thaler |
| 6,219,977 | B1 | 4/2001 | Chao et al. |
| 6,256,947 | B1 | 7/2001 | Grubb |

OTHER PUBLICATIONS

Solatube International, Inc., Solatube SolaMaster Series, brochure, Date Unknown.

*Primary Examiner*—Carl D. Friedman
*Assistant Examiner*—Basil Katcheves
(74) *Attorney, Agent, or Firm*—Webb Ziesenheim Logsdon Orkin & Hanson, P.C.

(57) ABSTRACT

A roofing assembly that includes a profiled roof deck plate attached to an adaptor for receiving and securing skylights to a roof structure.

40 Claims, 6 Drawing Sheets

DECKING FOR RECEIPT OF SKYLIGHTS

BACKGROUND OF THE INVENTION

1. Field of the Invention

The present invention relates generally to the installation of skylights in a roof structure and, more particularly, to roof decking for receipt of skylights.

2. Description of the Prior Art

The conveying of outdoor light into an interior room through a roof-mounted skylight is well known in the art. In particular, tubular skylights commercially available from Solatube International, Inc. have a compact design and are used to provide natural lighting to both homeowners and businesses without the drawbacks of the traditional box-type skylights. These tubular skylights have a compact roof-mounted reflector system that collects light and directs it down a highly reflective cylinder to a light diffuser at the ceiling level that looks like a standard light fixture. Under optimal installations, the compact design of a tubular skylight enables a 10-inch diameter tubular skylight to provide up to 150 square feet more illumination than a two-foot-square box-type skylight, thus providing for smaller openings in the roof structure than traditional skylights. These tubular skylights are described in U.S. Pat. Nos. 5,099,622 and 5,655,339, which are hereby incorporated by reference. In addition, a collimating tubular skylight that tapers outward at the outlet, such as the Solar Megaphone™, commercially available from Naturalite Skylight Systems, can also provide more illumination without the large opening to the roof structure than traditional skylights. These collimating skylights have a highly reflective type of tube that directs light to a light diffuser at the ceiling level. The diameter of the tube at the outlet maybe greater than the diameter of the tube at the inlet, thus providing for smaller openings in the roof structure than traditional skylights.

FIG. 1 shows a typical prior art tubular skylight 1, such as Solatube's SolaMaster® Series Skylight. The skylight 1 includes a roof-mounted, dome-like transparent cover 5 attached to a first end 3 of an internally reflective elongated hollow body 2 and a lens 6 such as a light diffuser attached to a second end 4 of the body 2 via a transition piece 9. The transition piece 9 adapts to accommodate the different sizes and shapes of the lens 6. The skylight 1 also has a first flange 7 surrounding the hollow body 2 at the first end 3 and a second flange 8 surrounding the hollow body 2 at the second end 4. When installed, the second end 4 of the hollow body 2 extends downwardly from the roof to the ceiling of the room. Positioned at the ceiling level is the lens 6 for allowing outdoor light into the interior of the room.

In order to install the skylight 1, an opening is made in the roof structure. The opening is typically cut with power saws. If the roof structure has long-spanning (i.e., greater than or equal to 16 feet in length) and/or deep (i.e., greater than 3 inches deep) structural ceiling decks, then burning torches are typically used to cut the opening. Depending on the size and location of the opening, reinforcing support frames may be required to maintain the structural integrity of the roof at the skylight location. However, these field-made openings in the roof structure of long-spanning and/or deep ceiling decks are very difficult, if not impossible, to cut and/or reinforce. Often these field cut openings in the roof deck result in visual problems on the exposed surface of the roof and even, in some cases, results in eliminating the skylight installation option from some designs. Moreover, the additional framing which is visible from the ceiling can also detract from the design. Next, the opening in the roof, through which the skylight 1 extends, is sealed with a flashing mounted upon the roof of the building. The standard flashing includes a base portion that extends parallel to the roof of the building that surrounds the skylight 1. Therefore, the flashing covers the opening in the roof to provide a watertight seal around the hollow body 2 of the skylight 1, thus preventing external elements from traveling between the roof and the skylight 1. The first flange 7 of the skylight 1 follows the slope of the roof and is attached to the roof using asphalt or other glue compounds to assure watertightness between the hollow body 2 and the roof. However, when an adhesive, such as caulking or asphalt, is the sole means for securing the skylight 1 at the first end 3, the skylight 1 can usually work itself loose of the bond when the roof deteriorates. Therefore, an object of the present invention is to provide a structurally sound, architecturally pleasing installation for circular skylights installed through structural ceiling decks.

In other installations, where the hollow body of a skylight has differing size and geometrical shapes, it is critical to provide a long-lasting, watertight seal of the gaps that exist between the flashing and the hollow body. Commonly, such gaps are sealed by caulking with resilient materials, such as silicone. However, the use of caulking requires that close tolerances be maintained to assure that the gap to be sealed is sufficiently narrow for a caulk seal to be established. However, when the gap between the opening in a roof deck and the body of the skylight is large, an adhesive material, such as duct tape, is typically used to close or narrow this gap. Eventually, the caulking seal and adhesive will break down because of movement of the roof flashing and the skylight due to expansion and contraction of their components due to seasonal temperature changes. Therefore, there is a need to match the opening size and location in the roof deck to accommodate the different shapes and designs of skylights. This requires quite a bit of measuring, cutting and installation skills, which increase installation time and expense. Therefore, it is an object of the present invention to reduce the required skill level and the installation time by providing pre-located, pre-made openings for securing skylights through the roof system.

SUMMARY OF THE INVENTION

The present invention is an adaptor for securing a skylight to a roof deck that includes a hollow open-ended body having an inner surface and an outer surface wherein a cavity is defined by the inner surface of the body. The body also includes a first end and a second end that can be geometrically shaped, such as frusto-conical, cylindrical or rectangular. A first flange is attached to the first end of the body and extends radially outwardly away from the cavity. A second flange is attached to the second end of the body and extends radially outwardly away from the cavity.

The present invention is also an adaptor having a first section and second section. The first section has a first axially extending body having an inner surface and an outer surface, wherein the inner surface of the first body defines a first cavity. The first body also has a first outwardly extending radial flange extending away from the first cavity. The second section of the adaptor has a second axially-extending body having an inner surface and an outer surface, wherein the inner surface of the second body defines a second cavity. The second body also has a second outwardly-extending radial flange extending away from the second cavity. The first body and the second body are attached to each other so that a tube receiving recess is defined by the inner surface of the first body and the second body. A panel receiving recess is defined by the first flange, at least a portion of the outer surface of the first body and the second body, and the second flange. The first body and the second body can be geometrically shaped, such as frusto-conical, cylindrical or rectangular, and can be attached by mechanical fasteners, such as rivets. Further, the first body, the second body, the first flange, and the second flange can be coaxial.

Another aspect of the present invention is a roofing assembly for securing a skylight to a roof structure. The roofing assembly includes the above-described adaptor secured to a profiled deck plate. The deck plate defines a peripheral edge having a first surface and a second surface. The deck plate further includes a plurality of laterally-spaced, longitudinally-extending protruding ribs defining a portion of the deck plate. The ribs extend in a same direction as a length of the deck plate. Preferably, the length of the deck plate is at least 16 feet. Each of the ribs includes spaced apart sidewalls connected to a top wall. The sidewalls can be angled toward each other defining a frusto-triangular profile or parallel to each other defining a rectangular profile. The ribs extend from a first end of the plate to a second end of the plate. The sidewalls and top wall of each rib define a recessed area on the first surface of the plate. The deck plate has a spacer separating each rib and a passageway defined on the plate. The adaptor passes through the passageway of the deck plate. The body of the adaptor fits the contour of the passageway. The passageway can have any geometrically-shaped profile depending on the shape of the adaptor. In order to secure the adaptor to the deck plate, the first flange of the adaptor is attached to the first surface of the deck plate, and the second flange of the adaptor is attached to the second surface of the deck plate. The first flange and second flange of the adaptor can be welded or bolted to the deck plate.

The present invention further includes the roofing assembly as described above having a skylight received by the adaptor and secured to the profiled deck plate. The skylight includes an elongated hollow body having a first end and a second end. A cover is attached to the first end and a lens is attached to the second end. The roofing assembly can also include a plurality of skylights received by an adaptor and secured to a deck plate.

The present invention is also a method for mounting a skylight in a roofing structure that includes the steps of (1) providing a profiled deck plate defining a peripheral edge having a first surface and a second surface, the deck plate comprising a plurality of laterally-spaced, longitudinally-extending protruding ribs defining a portion of the plate, each of the ribs includes spaced apart sidewalls connected to a top wall, the ribs extending from a first end of the plate to a second end of the plate, the sidewalls and the top wall of each rib defining a recessed area on the second surface of the plate, a spacer separating each rib on the plate, and a passageway defined on the plate; (2) providing an adaptor having a hollow open-ended body having an inner surface and an outer surface, the body having a first end and a second end, the inner surface of the body defining a cavity, a first flange attached to the first end of the body and extending radially outwardly away from the cavity, and a second flange attached to the second end of the body and extending radially outwardly away from the cavity; (3) forming or cutting a passageway through the profiled deck plate; (4) reinforcing the passageway of the profiled deck plate; (5) securing the adaptor to the profiled deck plate through the passageway; and (6) installing a skylight through the adaptor in the profiled deck plate.

DETAILED DESCRIPTION OF THE INVENTION

Figure 2:
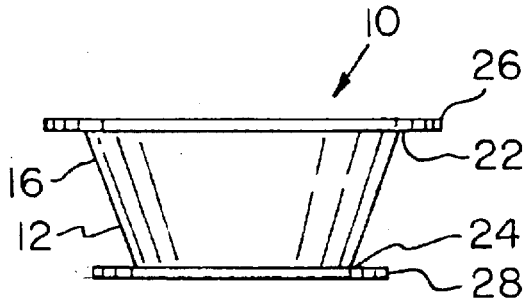
FIG. 2 is an elevational view of a first embodiment of an adaptor made in accordance with the present invention.
Figure 3:
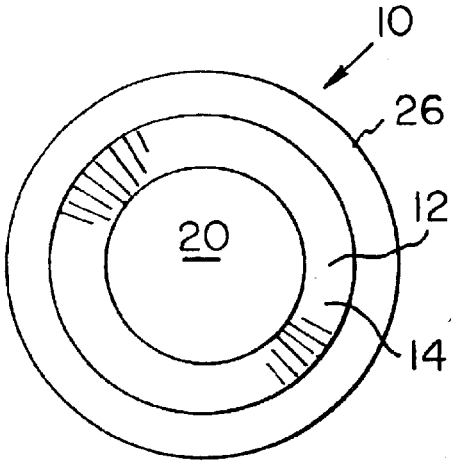
FIG. 3 is a top elevational view of the adaptor shown in FIG. 2.

FIGS. 2 and 3 show an adaptor 10 made in accordance with the present invention for securing a skylight to a roof deck. The adaptor 10 includes a frusto-conical shaped hollow open-ended body 12 having an inner surface 14 and outer surface 16, wherein the inner surface 14 of the body 12 defines a cavity 20 (shown in FIG. 3). The body 12 further includes a first end 22 and a second end 24. A first flange 26 is attached to the first end 22 of the body 12 and extends radially outwardly away from the cavity 20, and a second flange 28 is attached to the second end 24 of the body 12 and extends radially outwardly from the cavity 20.

Figure 4:
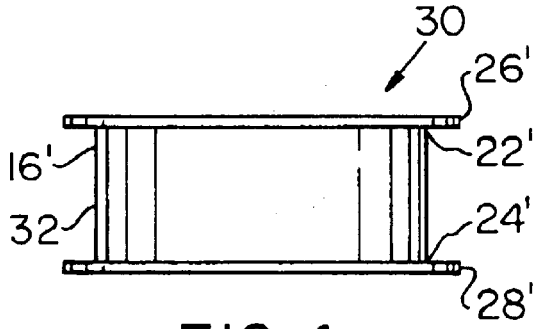
FIG. 4 is an elevational view of a second embodiment of an adaptor made in accordance with the present invention.
Figure 5:
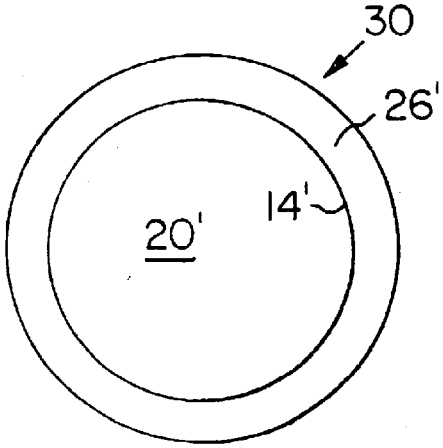
FIG. 5 is a top elevational view of the adaptor shown in FIG. 4.

FIGS. 4 and 5 show a cylindrical-shaped adaptor 30 made in accordance with the present invention for securing a skylight to a roof deck. The adaptor 30 includes a cylindrical-shaped hollow open-ended body 32 having an inner surface 14' and an outer surface 16', wherein the inner surface 14' of the body 32 defines a cavity 20' (shown in FIG. 5). The body 32 further includes a first end 22' and a second end 24'. A first flange 26' is attached to the first end 22' of the body 32 and extends radially outwardly away from the cavity 20', and a second flange 28' is attached to the second end 24' of the body 32 and extends radially outwardly from the cavity 20'.

Figure 6:
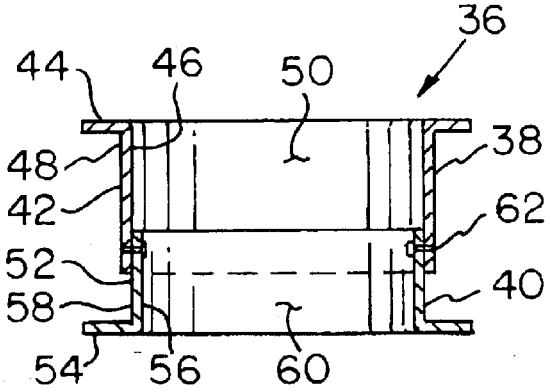
FIG. 6 is an elevational sectional view of a third embodiment of an adaptor made in accordance with the present invention.
Figure 7:
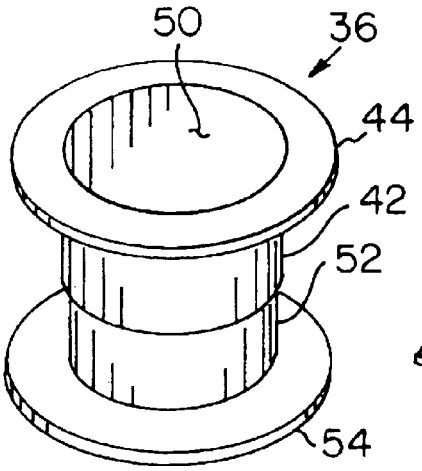
FIG. 7 is a top perspective view of the adaptor shown in FIG. 6.

FIGS. 6 and 7 show an adaptor 36 made in accordance with the present invention having a first section 38 and a second section 40. The first section 38 of the adaptor 36 includes a first axially-extending body 42 having an inner surface 46 and an outer surface 48, wherein the inner surface 46 of the first body 42 defines a first cavity 50. The first body 42 further includes a first outwardly-extending radial flange 44 extending away from the first cavity 50. The second section 40 of the adaptor 36 includes a second axially-extending body 52 having an inner surface 56 and an outer surface 58, wherein the inner surface 56 of the second body 52 defines a second cavity 60. The second body 52 further includes a second outwardly-extending radial flange 54 extending away from the second cavity 60. The first body 42 and second body 52 are attached to each other so that a tube receiving recess is defined by the inner surfaces 46 and 56 of the first body 42 and the second body 52, respectively. The first body 42 and the second body 52 are attached to each other via mechanical fasteners 62, such as rivets or sheet metal screws. A panel receiving recess is defined by the first flange 44, the second flange 54, at least a portion of the outer surface 48 of the first body 42, and at least a portion of the outer surface 58 of the second body 52. The first body 42 and the second body 52 can be geometrically-shaped, such as cylindrical or rectangular shaped. The first body 42, second body 52, first flange 44, and second flange 54 are coaxial.

Figure 8:
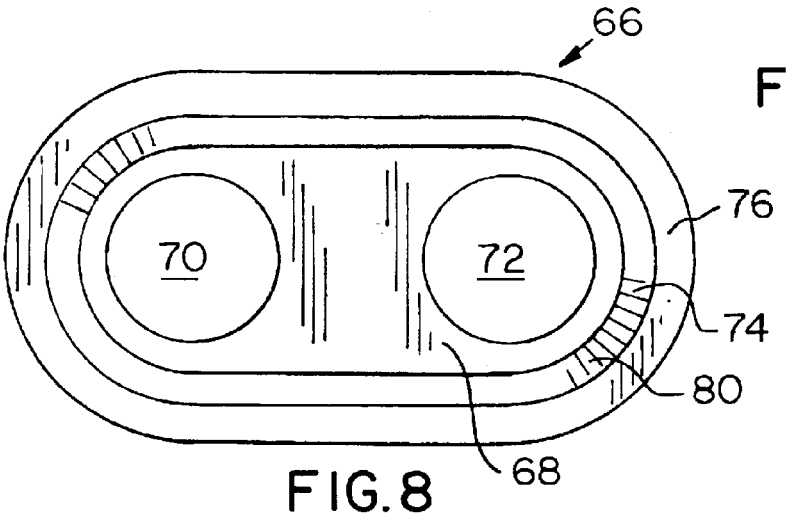
FIG. 8 is a top elevational view of a fourth embodiment of an adaptor made in accordance with the present invention.
Figure 9:
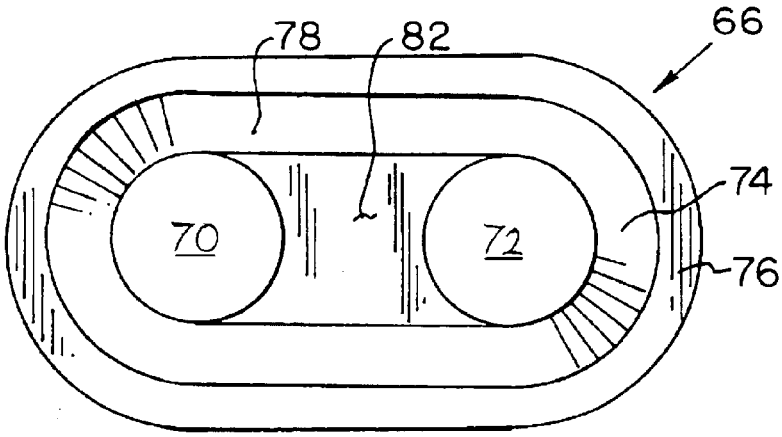
FIG. 9 is a bottom elevational view of the adaptor shown in FIG. 8.
Figure 13:
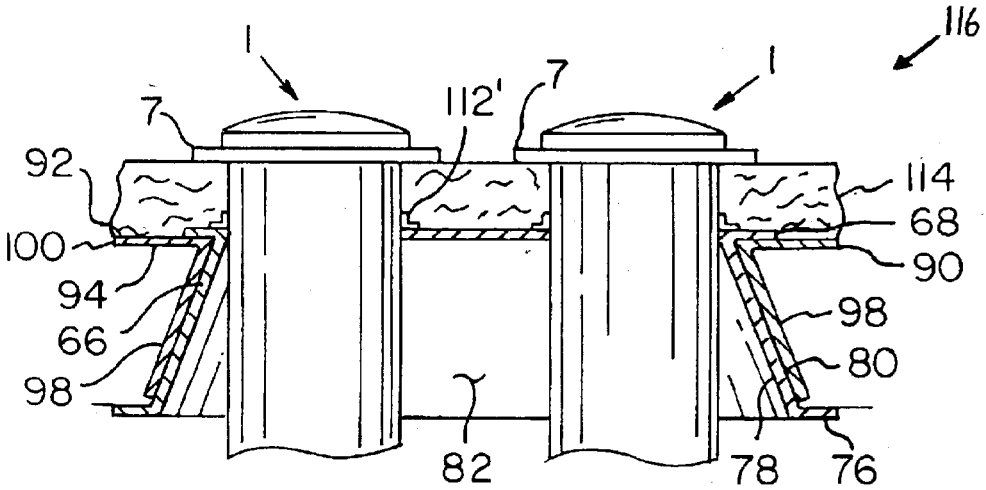
FIG. 13 is a front sectional view of a second embodiment of a roofing assembly made in accordance with the present invention having a plurality of skylights received within the roofing assembly.

FIGS. 8 and 9 show an oval-shaped adaptor 66 made in accordance with the present invention for securing a plurality of skylights. The adaptor 66 has a hollow open-ended body 74 having an inner surface 78 and an outer surface 80. The inner surface 78 of the body 74 defines a cavity 82. A body portion 68 having a flange extending therefrom is attached to one end of the body 74 and extends radially outwardly from the cavity 82. The body portion 68 includes a first passageway 70 and a second passageway 72 for receiving skylights as shown in FIG. 13. A second flange 76 is attached to an opposite end of the body 74 and extends radially outwardly from the cavity 82.

Figure 10:
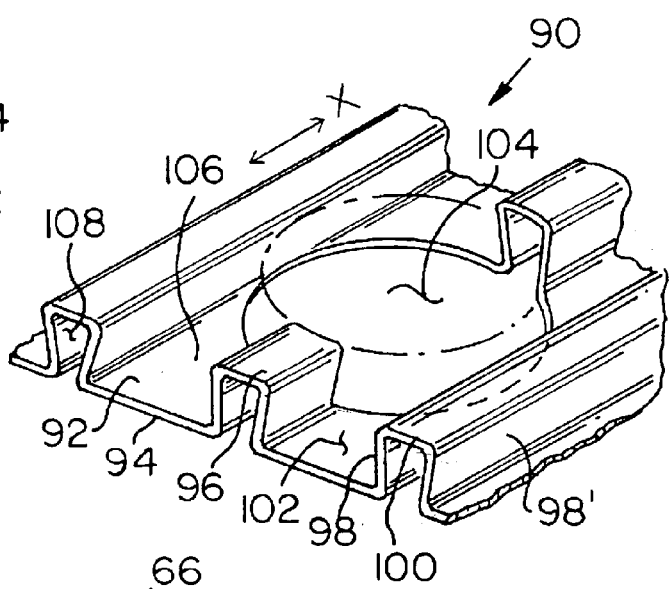
FIG. 10 is a top perspective view of a profiled deck plate having a passageway made in accordance with the present invention.
Figure 11:
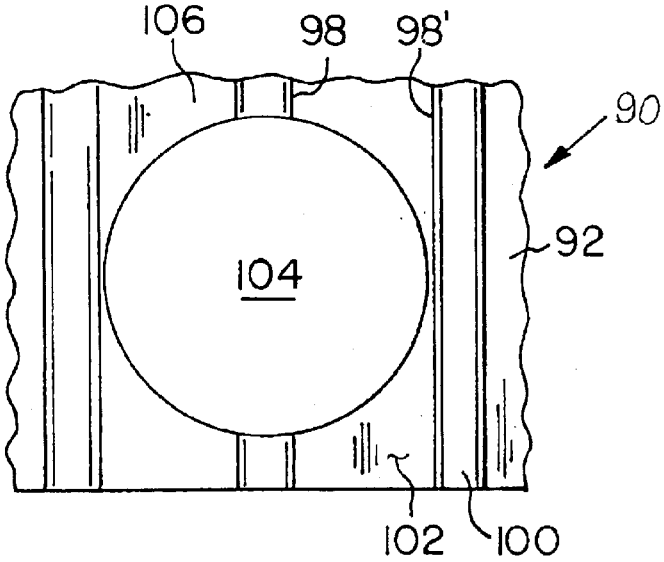
FIG. 11 is a top elevational view of a profiled deck plate shown in FIG. 10.

FIGS. 10 and 11 show a profiled deck plate 90 defining a peripheral edge and having a first surface 92 and a second surface 94. The deck plate 90 includes a plurality of laterally-spaced, longitudinally-extending protruding ribs 96 defining a portion of the plate 90. Preferably, the plurality of longitudinally-extending protruding ribs 96 extend in the longitudinal direction X. The deck plate 90 has a length and a width where the length extends in the X direction. The length of the deck plate 90 can be 16 feet or more and more than three inches deep. Each of the ribs 96 includes spaced apart sidewalls 98, 98' connected to a top wall 100. The ribs 96 extend from one end of the plate 90 to the opposite end of the plate 90, wherein the sidewalls 98, 98' and the top wall 100 define a hollow rib chamber 108 on the second surface 94. A recessed area 102 on the first surface 92 is defined by the sidewalls 98, 98' and the top wall 100 of each rib 96 on the plate 90. A spacer 106 separates each rib 96 on the deck plate 90. The sidewalls 98, 98' of the deck 90 can be angled toward each other defining a frusto-triangular (i.e. dovetail) profile (shown in FIG. 10) or parallel to each other defining a rectangular profile (not shown). A passageway 104, which can be shaped to receive any geometrically-shaped adaptor, is also defined on the deck plate 90. As stated previously, the present adaptor can be used with a profiled deck having different shaped rib profiles, such as, for example, rectangular, frusto-triangular (i.e. dovetail) or trapezoid, to name a few. Such examples of profiled decks are WIDECK® and WIDECK LONGSPAN® roof deck products manufactured by Epic Metals Corporation, assignee of the present application.

Figure 1:
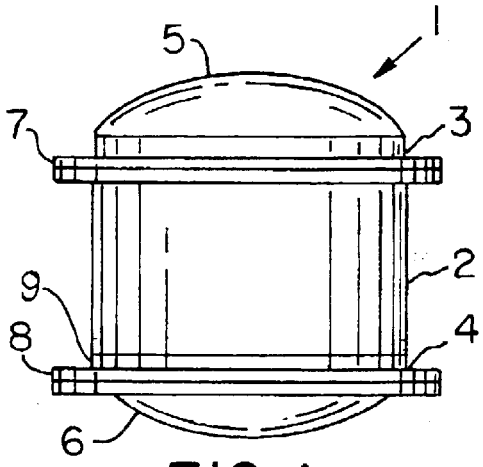
FIG. 1 PRIOR ART
FIG. 1 is an elevational view of a prior art tubular skylight.
Figure 12:
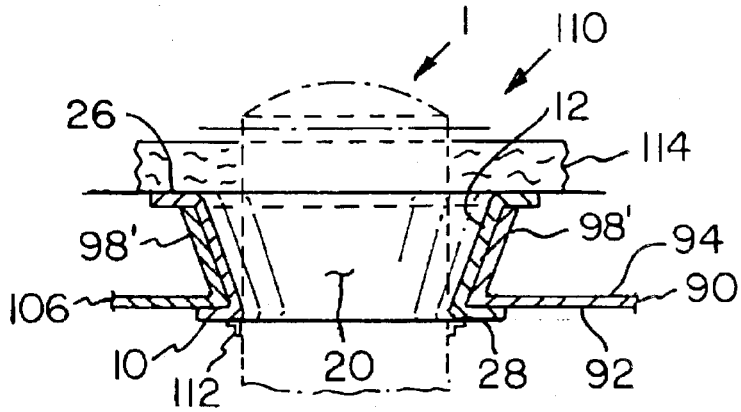
FIG. 12 is a front sectional view of a first embodiment of a roofing assembly made in accordance with the present invention showing in phantom the skylight of FIG. 1 received within the roofing assembly.

FIG. 12 shows a roofing assembly 110 made in accordance with a first embodiment of the present invention having a tubular skylight 1 (shown in phantom) received within the roofing assembly 110. The tubular skylight 1 (shown in FIG. 1), such as the SolaMaster® Series Skylight, commercially available from Solatube International, Inc., or the Solar Megaphone™ skylight commercially available from Naturalite Skylight Systems, includes a roof-mounted, dome-like transparent cover 5 attached to a first end 3 of an internally reflective elongated hollow body 2. The hollow body 2 can be an adjustable circular tube, or a tapered tube, made from aluminum sheet having a reflective silver finish. The hollow body 2 can also be angled for installation flexibility and can be easily reconfigured to accommodate future interior layout changes. A lens 6, such as a light diffuser, is attached to a second end 4 of the body 2 via a transition piece 9 and is positioned at the ceiling level for allowing outdoor light into the interior of the room. The transition piece 9 which, for example, can adapt to fit a standard T-bar drop ceiling tile grid, is used to attach varying sizes and shapes of the lens 6 such as a square light diffuser to the second end 4 of the hollow body 2. The skylight 1 also has a first flange 7 surrounding the hollow body 2 at the first end 3 and a second flange 8 surrounding the hollow body 2 at the second end 4.

With reference to FIGS. 11 and 12, the roofing assembly 110 includes the adaptor 10 attached to the profiled deck plate 90. The body 12 of the adaptor 10 passes through the passageway 104 (shown in FIG. 11) of the deck plate 90 and the first flange 26 is attached to the second surface 94 of the deck plate 90. The second flange 28 of the adaptor 10 is attached to the first surface 92 of the deck plate 90. The body 12 of the adaptor 10 fits the contour of the passageway 104. The first flange 26 and the second flange 28 of the adaptor 10 can be welded, bolted or attached by any mechanical fasteners to the deck plate 90. The tubular skylight 1 (shown in phantom) is received within the adaptor 10 and secured to the adaptor via mechanical fasteners 112.

FIG. 13 shows a roofing assembly 116 made in accordance with a second embodiment of the present invention having a plurality of skylights 1 are received by adaptor 66 and secured to the adaptor 66 via mechanical fasteners 112'. The first flange 7 of the skylight 1 rests on roofing material 114. The adaptor 66 is secured to the deck plate 90 via the first flange 68 and the second flange 76 attached to the first surface 92 and the second surface 94 of the deck plate 90, respectively.

Figure 14:
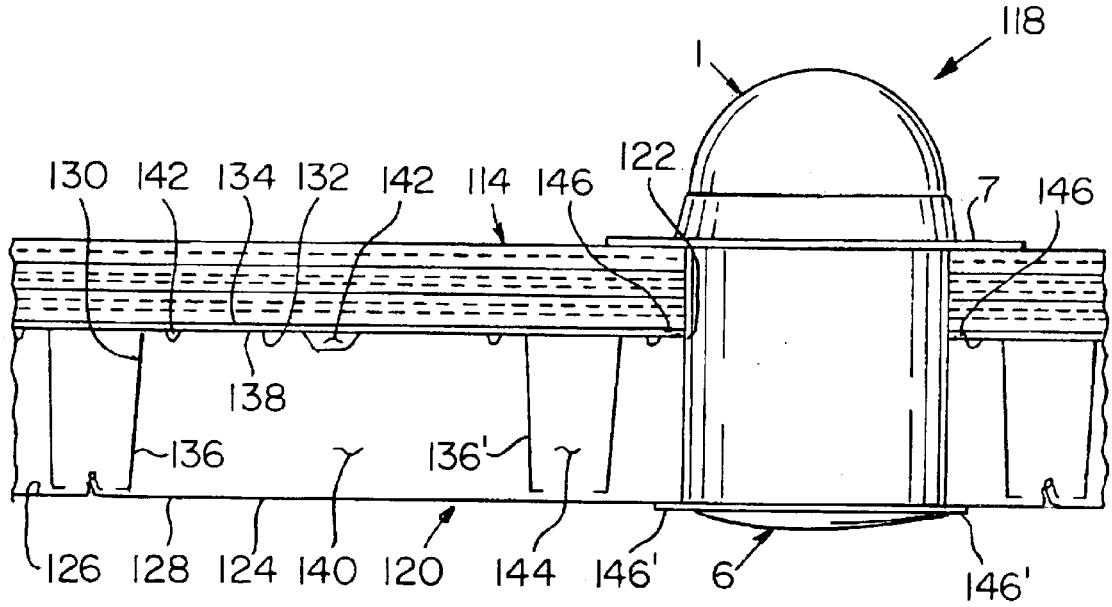
FIG. 14 is a front sectional view of a third embodiment of a roofing assembly made in accordance with the present invention having a reinforcing ring attached to a profiled deck plated.

FIG. 14 shows a roofing assembly 118 made in accordance with a third embodiment of the present invention having a tubular skylight 1 received within the roofing assembly 118. The roofing assembly 118 includes a profiled deck plate 120, a passageway 122 defined in the deck plate 120 and a pair of reinforcing rings 146, 146' surrounding the passageway 122 and attached to the deck plate 120. The deck plate 120, such as the WIDECK LONG SPAN® roof deck plates, includes a base plate 124 defining a peripheral edge and having a first surface 126 and a second surface 128, a plurality of laterally-spaced longitudinally-extending protruding ribs 130 attached to the first surface 126 of the base plate 124 and extending in a longitudinal direction Y (shown in FIG. 15). The deck plate 120 has a length and a width where the length extends in the Y direction. The length of the deck plate 120 can be 16 feet or more and more than three inches deep. Each of the ribs 130 having an inner surface 132 and an outer surface 134 include spaced apart side walls 136, 136' connected to a top wall 138. The ribs 130 extend from one of the ends of the base plate 124 to the opposite end of the base plate 124, wherein the inner surface 132 of the rib 130 defined by side walls 136, 136', and top wall 138 and the first surface 126 of the base plate 124 define a hollow rib chamber 140. A plurality of recess areas 142 are defined on the outer surface 134 of the top wall 138 of each rib 130. Also, the outer surface 134 of side walls 136, 136' of each rib 130 and the first surface 126 of the base plate 124 define a cavity 144 which separates each rib 130 on the base plate 124. The side walls 136, 136' of the ribs 130 are parallel to each other defining a rectangular profile.

Figure 15:
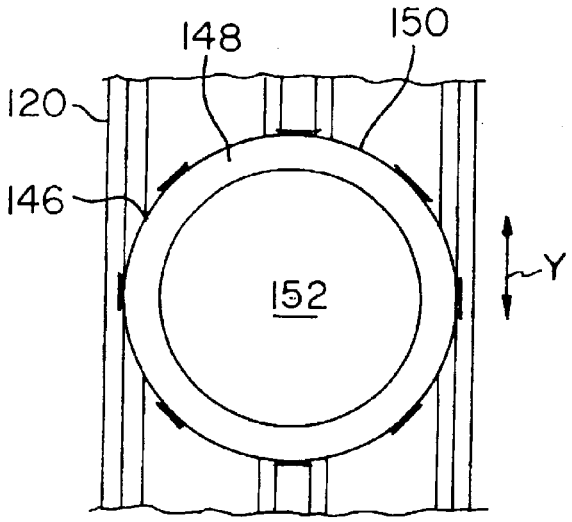
FIG. 15 is a top elevational view of the reinforcing ring attached to the profiled deck plate shown in FIG. 14.

With reference to FIGS. 14 and 15, the roofing assembly 118 includes a first ring 146 surrounding the passageway 122 and attached to the outer surface 134 of a portion of the top wall 138 of at least one rib 130 and a second ring 146' surrounding the passageway 122 and attached to the second surface 128 of the base plate 124. The ring 146 (shown in FIG. 15) includes an annular body 148 defining a peripheral edge 150 and a center opening 152 spaced apart from the peripheral edge 150. The body 148 of the ring 146 is preferably made of a one-piece sixteen-gauge metal material. The ring 146 can be attached to the deck plate 120 by welding, bolting or attaching by any other mechanical fasteners.

Figure 16:
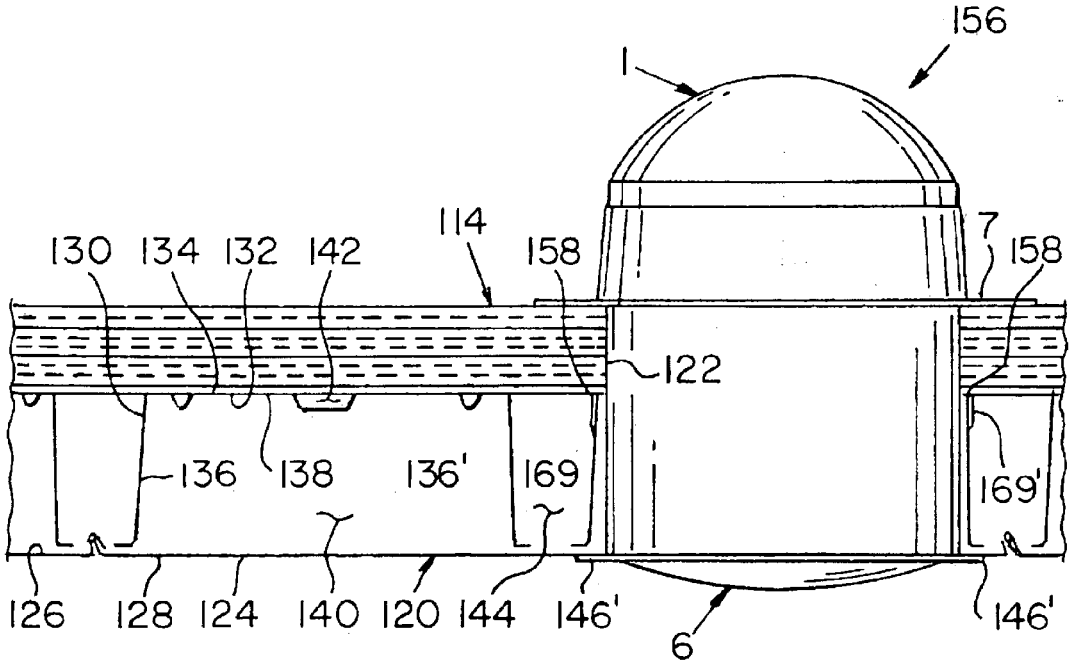
FIG. 16 is a front sectional view of a fourth embodiment of a roofing assembly made in accordance with the present invention having a reinforcing plate attached to a profiled deck plate.
Figure 18:
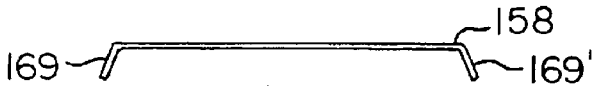
FIG. 18 is a side elevational view of the reinforcing plate shown in FIG. 17.
Figure 17:
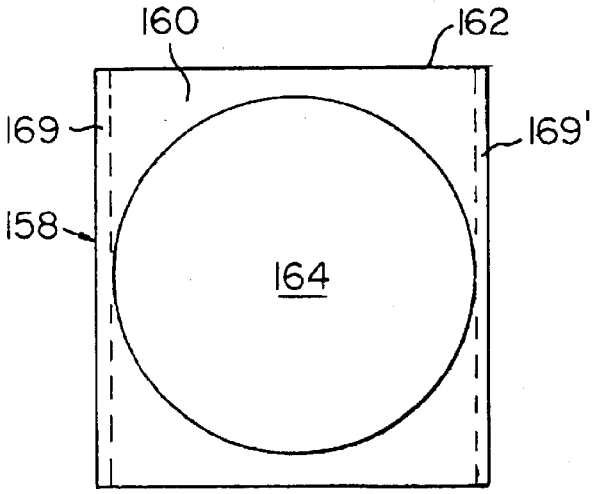
FIG. 17 is a top elevational view of the reinforcing plate shown in FIG. 16.

FIG. 16 shows a roofing assembly 156 made in accordance with a fourth embodiment of the present invention that is similar to roofing assembly 118 wherein the only difference is that the first ring 146 is replaced with a reinforcing plate 158. With reference to FIGS. 17 and 18, the plate 158 includes a body 160 defining a peripheral edge 162, a center passageway 164 spaced apart from the peripheral edge 162 of the body 160, and a pair of lips 169, 169', wherein a first lip 169 extends from one end of the edge 162 of the body 160 and a second tapered lip 169' extends from the opposite end of the edge 162 of the body 160. The body 160 of the plate 158 is preferably made of a one-piece sixteen-gauge metal material. In roofing assembly 156, the reinforcing plate 158 surrounds the passageway 122 in the deck plate 120 and is attached to the outer surface 134 of a portion of the top wall 134 and side walls 136, 136' of at least one rib 130. The reinforcing plate 158 can be attached to the deck plate 120 by welding, bolting, or attaching by any other mechanical fasteners.

Figure 19:
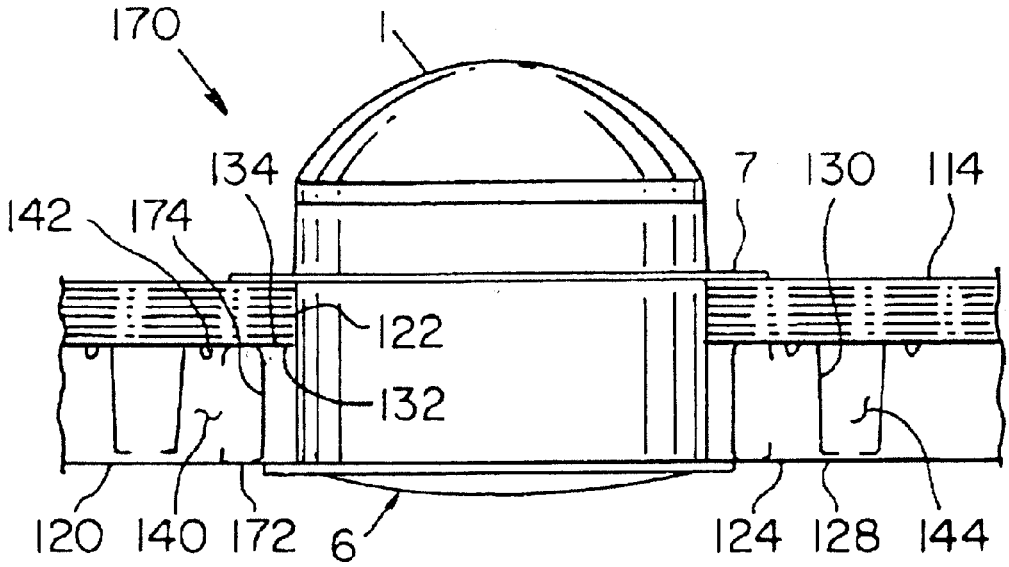
FIG. 19 is a front sectional view of a fifth embodiment of a roofing assembly made in accordance with the present invention having reinforcing channels attached to a profiled deck plate.
Figure 20:
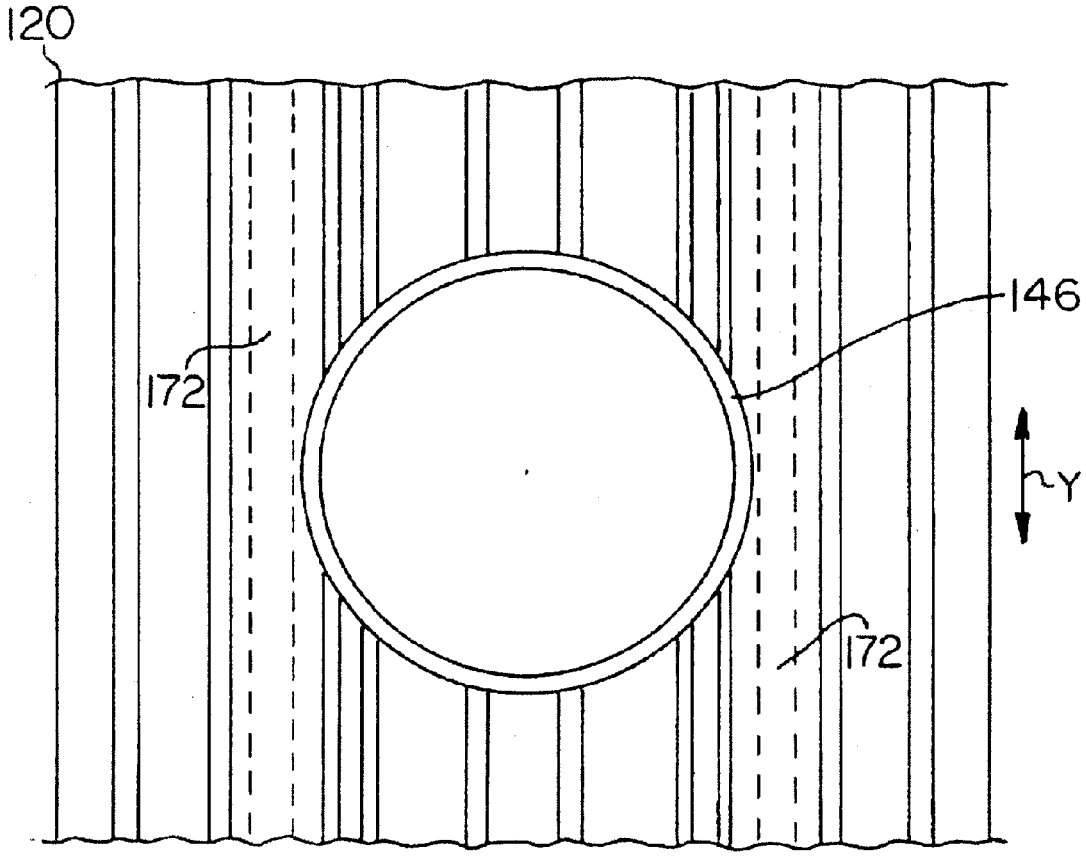
FIG. 20 is a top elevational view of the reinforcing channels attached to the profiled deck plate shown in FIG. 19.

FIGS. 19 and 20 show a roofing assembly 170 made in accordance with a fifth embodiment of the present invention that is similar to roofing assembly 118 and includes reinforcing channels 172 surrounding the passageway 122 and attached to the profiled deck plate 120. The channels 172 having a U-shaped cross section 174 can extend the width and length of the deck plate 120. The channels 172 can also be attached to the deck plate 120 by welding, bolting, or attaching by any other mechanical fasteners.

In operation, installing or mounting a skylight or a plurality of skylights on a roof structure includes the step of providing a profiled deck plate and an adaptor as described above. The adaptor is configured to match the size and shape of a skylight in order for the skylight to be received by the adaptor. Preferably, the adaptor is made of sheet metal. Next, a passageway is formed in the deck plate matching the size and shape of the adaptor in order for the adaptor to be received within the passageway. The passageway can be reinforced by attaching support members such as reinforcing channels or members 172 to the deck plate within a reinforcing member passageway, such as the hollow rib chamber 140 defined in ribs 130. The adaptor is then placed through the passageway and secured to the deck plate. Securing the adaptor can be accomplished by welding, bolting or attaching by any other mechanical fasteners the first flange and the second flange of the adaptor to each surface of the deck plate. Finally, the skylight is received by the adaptor and secured to the adaptor via welding or mechanical fasteners. As stated previously, field-made openings through long-spanning and/or deep decks are very difficult, if not impossible, to cut and reinforce. Often these field-cut decks result in a visual problem on the exposed surface and even in some cases results in eliminating the skylight. The present invention overcomes this problem by providing a more structurally sound and architecturally pleasing installation. Therefore, preferably field cutting of the roof deck is eliminated by cutting pre-located holes in the deck prior to installation of the deck. This can be done at the job site, at a prefabrication facility or at the facility manufacturing the deck. Further, the adaptor can be assembled in any of the above described facilities prior to installation of the deck. The skylights can then be installed either prior to installation of the deck or after installation. Hence, the present invention permits the use of skylights in roof designs where, in the past, because of structural or architectural demands, it was thought to be unfeasible. Also, an advantage of the present design is that the adaptor will not affect the structural integrity of the roof deck span of 16 feet or greater.

The present invention provides for a more structurally sound, architecturally pleasing installation by eliminating both the field-made openings and the reinforcing of the skylight openings. Installation time is also greatly reduced because the openings are pre-located and installed prior to installation of the roof system. The present invention also allows the use of skylights in roof designs where in the past, because of structural or architectural demands, it was thought to be unfeasible.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

What is claimed is:

1. A roofing assembly for securing a skylight to a roof structure, said roofing assembly comprising:

a profiled deck plate defining a peripheral edge having a first surface and a second surface;

a plurality of laterally-spaced, longitudinally-extending protruding ribs defining a portion of said plate, each of said ribs includes spaced apart sidewalls connected to a top wall, said ribs extending from a first end of said plate to a second end of said plate, said sidewalls and said top wall of each rib defining a recessed area on said first surface of said plate, said sidewalls are angled toward each other defining a dovetail profile;

a spacer separating each rib on said plate;

a passageway defined on said plate; and an adaptor comprising a hollow open-ended body having an inner surface and an outer surface, said body having a first end and a second end, said inner surface of said body defining a cavity, and a first flange attached to said body and extending radially outwardly away from said cavity, wherein said body of said adaptor passes through said passageway, said first flange is attached to said profiled deck plate said adaptor defining a passageway for receiving a skylight having an elongated hollow body, and wherein said adaptor provides structural support to said profiled deck plate.

2. The roofing assembly as claimed in claim 1, wherein said passageway has a geometrically-shaped profile.

3. The roofing assembly as claimed in claim 1, wherein said passageway has a circular profile.

4. The roofing assembly as claimed in claim 1, wherein said body of said adaptor fits the contour of said passageway.

5. The roofing assembly as claimed in claim 1, wherein said first flange is welded to said deck plate.

6. The roofing assembly as claimed in claim 1, wherein said first flange is bolted or riveted to said deck plate.

7. The roofing assembly as claimed in claim 1, further comprising a skylight, said skylight comprising an elongated hollow body having a first end and a second end, a cover attached to said first end of said body, and a lens attached to said second end of said body, wherein said skylight is received by said adaptor.

8. The roofing assembly as claimed in claim 7, wherein said skylight coacts with said deck plate and said adaptor.

9. The roofing assembly as claimed in claim 1, further comprising a plurality of skylights, each of said skylights comprising an elongated hollow body having a first end and a second end, a cover attached to said first end of said body, and a lens attached to said second end of said body, wherein said skylights are received by said adaptor.

10. The roofing assembly as claimed in claim 1, further comprising a tubular skylight, said skylight comprising an internally reflective adjustable circular tube having a first end and a second end, a transparent cover attached to said first end of said tube, a transition piece attached to said second end of said tube, and a light diffuser attached to said transition piece, wherein said tubular skylight is received by said adaptor.

11. The roofing assembly as claimed in claim 1, wherein said plurality of longitudinally-extending ribs extend in a same direction as a length of said deck plate, wherein the length of said deck plate is at least sixteen feet.

12. The roofing assembly as claimed in claim 11, wherein said deck plate has a depth greater than three inches.

13. The roofing assembly as claimed in claim 10, further comprising a reinforcing member received within a passageway defined by said profiled deck.

14. The roofing assembly as claimed in claim 1, wherein said first flange is attached to a first end of said body and attached to a said first surface of said profiled deck plate.

15. The roofing assembly as claimed in claim 14, further comprising a second flange extending radially outwardly from said cavity and attached to said second end of said body, said second flange attached to said second surface of said profiled deck plate.

16. The roofing assembly as claimed in claim 1, further comprising a second flange extending radially outwardly from said cavity and attached to said body and spaced from said first flange, said second flange attached to said profiled deck plate.

17. The roofing assembly as claimed in claim 16, wherein said first flange and said second flange are welded to said deck.

18. The roofing assembly as claimed in claim 16, wherein said first flange and said second flange are bolted or riveted to said deck.

19. The roofing assembly as claimed in claim 1, wherein said adaptor body comprises a two-piece body.

20. The roofing assembly as claimed in claim 19, wherein said two pieces of said adaptor are secured to each other.

21. A method for mounting a skylight in a roof structure comprising the steps of:

a) providing a profiled deck plate defining a peripheral edge having a first surface and a second surface, said deck plate comprising a plurality of laterally-spaced, longitudinally-extending protruding ribs defining a portion of said plate, each of said ribs includes spaced apart sidewalls connected to a top wall, said ribs extending from a first end of said plate to a second end of said plate, said sidewalls and said top wall of each rib defining a recessed area on said first surface of said plate, a spacer separating each rib on said plate, and a passageway defined on said plate;

b) providing an adaptor comprising a hollow open-ended body having an inner surface and an outer surface, said body having a first end and a second end, said inner surface of said body defining a cavity, and a first flange attached to said body and extending radially outwardly away from said cavity;

c) forming a passageway through said profiled deck plate;

d) securing said adaptor to said profiled deck plate, said adaptor positioned within said passageway; and e) installing a skylight having an elongated hollow body through said adaptor in said profiled deck plate.

22. The method as claimed in claim 21, further comprising the step of:

reinforcing said passageway of said profiled deck plate by placing a reinforcing member within a passageway defined by said profiled deck.

23. The method as claimed in claim 21, wherein said first flange is attached to a first end of said body and attached to a said first surface of said profiled deck plate.

24. The method as claimed in claim 23, further comprising a second flange extending radially outwardly from said cavity and attached to said second end of said body, said second flange attached to said second surface of said profiled deck plate.

25. The method as claimed in claim 21, further comprising a second flange extending radially outwardly from said cavity and attached to said body and spaced from said first flange, said second flange attached to said profiled deck plate.

26. A roofing assembly for securing a skylight to a roof structure, said roofing assembly comprising:

a profiled deck plate defining a peripheral edge having a first surface and a second surface;

a plurality of laterally-spaced, longitudinally-extending protruding ribs defining a portion of said plate, each of said ribs includes spaced apart sidewalls connected to a top wall, said ribs extending from a first end of said plate to a second end of said plate, said sidewalls and said top wall of each rib defining a recessed area on said first surface of said plate;

a spacer separating each rib on said plate;

a passageway defined on said plate;

an adaptor comprising a hollow open-ended body having an inner surface and an outer surface, said body having a first end and a second end, said inner surface of said body defining a cavity, and a first flange attached to said body and extending radially outwardly away from said cavity, wherein said body of said adaptor passes through said passageway, said first flange is attached to said profiled deck plate, said adaptor defining a passageway for receiving a skylight having an elongated hollow body; and a plurality of support members directly attached to said profiled deck plate and positioned adjacent to said adaptor, said ribs and said support members extending in a longitudinal direction.

27. The roofing assembly as claimed in claim 26, wherein said support members are C-shaped.

28. The roofing assembly as claimed in claim 26, wherein said support members are secured to one side of said profiled deck plate.

29. The roofing assembly as claimed in claim 26, wherein said support members are received within a recess defined by said profiled deck plate.

30. The roofing assembly as claimed in claim 26, wherein said support members are not exposed on an underside of said profiled deck.

31. The roofing assembly as claimed in claim 26, wherein said deck plate has a depth greater than three inches.

32. The roofing assembly as claimed in claim 31, wherein a length of said deck plate is at least sixteen feet.

33. The roofing assembly as claimed in claim 26, wherein said first flange is attached to a first end of said body and attached to a said first surface of said profiled deck plate.

34. The roofing assembly as claimed in claim 33, further comprising a second flange extending radially outwardly from said cavity and attached to said second end of said body, said second flange attached to said second surface of said profiled deck plate.

35. The roofing assembly as claimed in claim 26, further comprising a second flange extending radially outwardly from said cavity and attached to said body and spaced from said first flange, said second flange attached to said profiled deck plate.

36. A method for mounting a skylight in a roof structure comprising the steps of:

a) providing a profiled deck plate defining a peripheral edge having a first surface and a second surface, said deck plate comprising a plurality of laterally-spaced, longitudinally-extending protruding ribs defining a portion of said plate, each of said ribs includes spaced apart sidewalls connected to a top wall, said ribs extending from a first end of said plate to a second end of said plate, said sidewalls and said top wall of each rib defining a recessed area on said first surface of said plate, a spacer separating each rib on said plate, and a passageway defined on said plate;

b) providing an adaptor comprising a hollow open-ended body having an inner surface and an outer surface, said body having a first end and a second end, said inner surface of said body defining a cavity, a first flange attached to said body and extending radially outwardly away from said cavity;

c) forming a passageway through said profiled deck plate;

d) securing said adaptor to said profiled deck plate, said adaptor positioned within said passageway;

e) providing a plurality of support members;

f) attaching said support members directly to said profiled deck plate and positioned adjacent to said adaptor, said ribs and said support members extending in a longitudinal direction; and g) installing a skylight having an elongated hollow body through said adaptor in said profiled deck plate.

37. The method for mounting a skylight as claimed in claim 36, wherein said support members are secured to one side of said profiled deck plate.

38. The method as claimed in claim 36, wherein said first flange is attached to a first end of said body and attached to a said first surface of said profiled deck plate.

39. The method as claimed in claim 38, further comprising a second flange extending radially outwardly from said cavity and attached to said second end of said body, said second flange attached to said second surface of said profiled deck plate.

40. The method as claimed in claim 36, further comprising a second flange extending radially outwardly from said cavity and attached to said body and spaced from said first flange, said second flange attached to said profiled deck plate.

* * * * *

UNITED STATES PATENT AND TRADEMARK OFFICE

CERTIFICATE OF CORRECTION

PATENT NO. : 6,813,864 B2
DATED : November 9, 2004
INVENTOR(S) : Landis

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 4,114,186 | 09/1978 | Dominguez |
| 5,062,247 | 11/1991 | Dittmer |
| 5,259,157 | 11/1993 | Ault |
| 1,792,704 | 02/1931 | Peverly -- |

Column 9,
Line 52, "as claimed in claim 10" should read -- as claimed in claim 1 --

Signed and Sealed this

Twenty-eighth Day of June, 2005

JON W. DUDAS
*Director of the United States Patent and Trademark Office*